United States Patent [19]

Masuda

[11] 3,930,815

[45] Jan. 6, 1976

[54] ELECTROSTATIC APPARATUS FOR REMOVING ENTRAINED PARTICULATE MATERIAL FROM A GAS STREAM

[76] Inventor: Senichi Masuda, 40-10-605, 1-chome, Hishigahara, Kita, Tokyo, Japan

[22] Filed: Dec. 9, 1974

[21] Appl. No.: 530,680

Related U.S. Application Data

[63] Continuation of Ser. No. 248,176, April 27, 1972, abandoned.

[30] Foreign Application Priority Data

May 12, 1971 Japan ..... 46-31860
May 31, 1971 Japan ..... 46-37675

[52] U.S. Cl. ..... 55/123; 55/124; 55/131; 55/139; 55/152; 55/341

[51] Int. Cl.[2] ..... B03C 3/02

[58] Field of Search ..... 55/124–126, 55/131, 123, 139, 152, 341

[56] References Cited

UNITED STATES PATENTS

| | | | |
|---|---|---|---|
| 1,428,839 | 9/1922 | Fortescue | 55/131 |
| 3,577,705 | 5/1971 | Sharlit | 55/126 |
| 3,733,784 | 5/1973 | Anderson et al. | 55/302 |
| 3,739,552 | 6/1973 | Webster et al. | 55/123 |

FOREIGN PATENTS OR APPLICATIONS

| | | | |
|---|---|---|---|
| 892,908 | 4/1962 | United Kingdom | 55/131 |

OTHER PUBLICATIONS

Masuda et al.–Electrodynamic Behavior of Charged Aerosol Particles in Non–Uniform Alkynating Fields and Its Application in Dust Control, Staub Reinhaltung der Luft Vol. 30, (1970), No. 11, pp. 4–15.

*Primary Examiner*—Bernard Nozick

[57] ABSTRACT

Apparatus for removing dust from a gas stream comprises a duct with an inlet at its top, a hopper spaced beneath the inlet, and a lateral outlet at a level between inlet and hopper. Gas flowing from inlet to outlet must traverse a vertically extending filter comprising elongated parallel electrodes laterally spaced from one another at small intervals. Each electrode is connected with a terminal of an alternating voltage source different from that with which its adjacent electrodes are connected. The constantly varying alternating electric fields at the filter repel particles so that they fall into the hopper.

5 Claims, 13 Drawing Figures

ELECTROSTATIC APPARATUS FOR REMOVING ENTRAINED PARTICULATE MATERIAL FROM A GAS STREAM

This application is a continuation of my copending application Ser. No. 248,176, filed Apr. 27, 1972 now abandoned.

This invention relates to apparatus by which particulate materials such as dust, small fibres, cement powder, fine ash and the like can be separated from a flowing gas stream in which they are entrained.

The invention is based upon the discovery by the inventor that small, light bodies such as dust particles, when electrically charged as by subjection to a corona discharge, are repelled and can be electrodynamically driven in one direction by a series of constantly varying alternating electric fields produced by applying an alternating voltage to a plurality of elongated parallel electrodes that are spaced apart laterally by small distances. Because the repelled particles are more or less levitated at one side of the array of electrodes, in a curtain-like cloud, the inventor has termed this effect an electric field curtain. If the electrodes are disposed in proximity to, or in contact with, a sheet or lamina of dielectric material, uncharged particles receive a charge when they come into contact with the surface of the dielectric material and are thereupon immediately repelled and strongly driven away from the dielectric surface by the constantly varying alternating electric fields. The inventor designates such apparatus as an electric field curtain of contact type.

If single-phase alternating voltage is applied to the electrodes, the particle bodies tend to be held in equilibrium positions between pairs of electrodes, but they can be moved from such positions by the force of gravity or of a flowing gas stream. The inventor designates this effect a stationary wave electric field curtain. If the electrodes are properly connected with the terminals of a polyphase alternating voltage source, the net electric field produced by the array of electrodes has a wave-like variation across the electrodes, and by reason of this travelling wave effect the particles tend to be advanced in one direction transversely to the electrodes as they are repelled from them. The inventor designates this latter effect a travelling wave electric field curtain.

The present invention relates to apparatus by which the electric field curtain effect can be advantageously utilized for removing particulate material from a gas stream in which it is entrained, and by which apparatus such material is collected in a manner that facilitates its reuse or other disposition. As distinguished from the well known electrostatic precipitator and from conventional filters, the apparatus of this invention tends to move particles directly to the interior of a hopper or similar collection zone, rather than causing them to be deposited upon a surface from which they must be removed from time to time by percussion, washing or a similar cleaning operation.

Thus the general object of this invention is to provide apparatus by which particulate materials entrained in a gas stream can be separated from the gas stream and moved directly to a collection zone such as the interior of a hopper.

It is also an object of the invention to provide apparatus that takes advantage of the electric field curtain effect to separate from a gas stream particles such as dust, fibres, paint and coloring powder, cement powder and the like, and wherein such particulate material is collected in a manner that facilitates its reuse or other disposition.

It will be apparent that the apparatus of this invention is useful in many industrial applications and processes such as electrostatic painting, electrostatic hair and fibre setting, electroprinting and electrostatic dyeing.

The invention will now be described with particular reference to the accompanying drawings, wherein.

Figure 6:
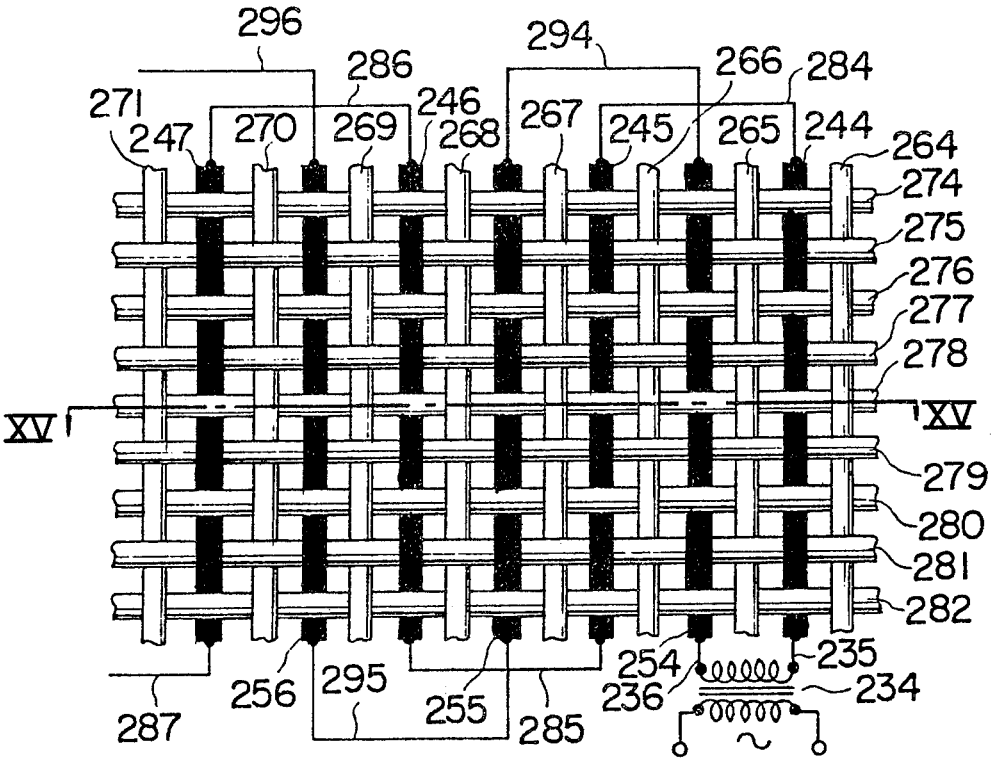
FIG. 6 is an enlarged plan and a connection diagram of a filter cloth for constituting an electric field curtain of contact type of stationary wave type.
Figure 8:
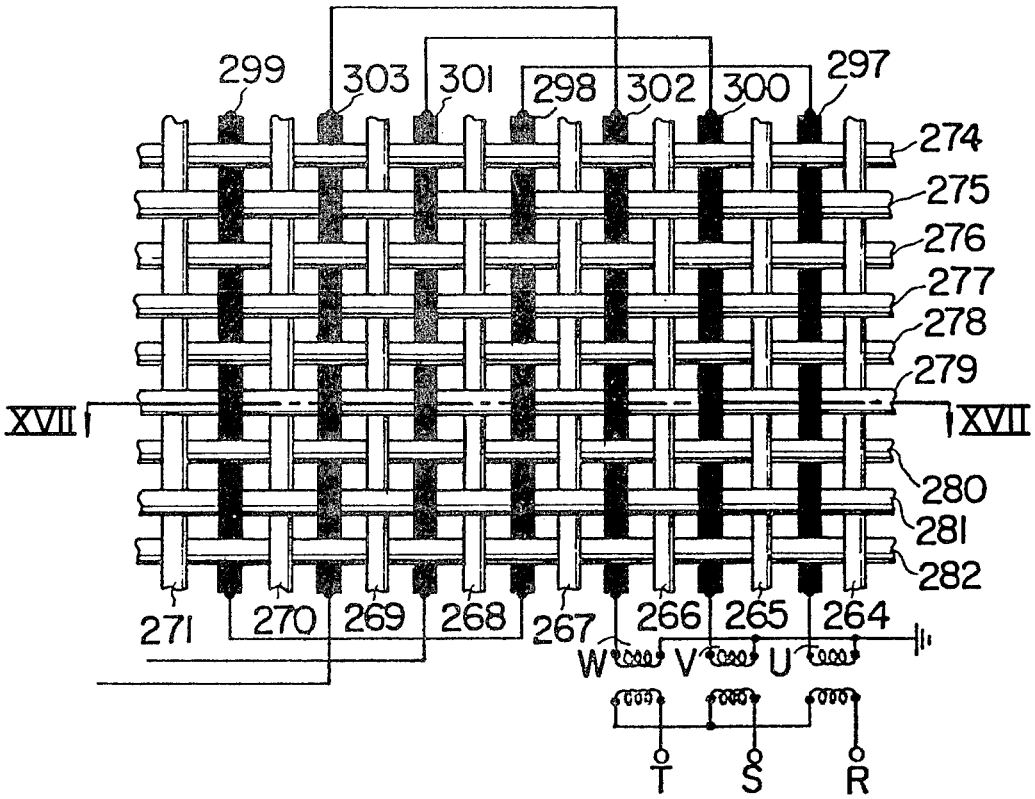
Figure 9:
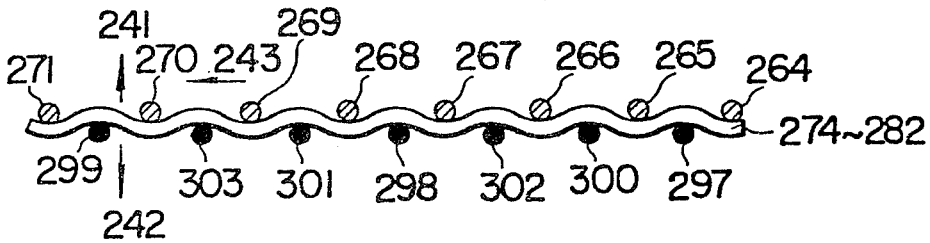
Figure 10:
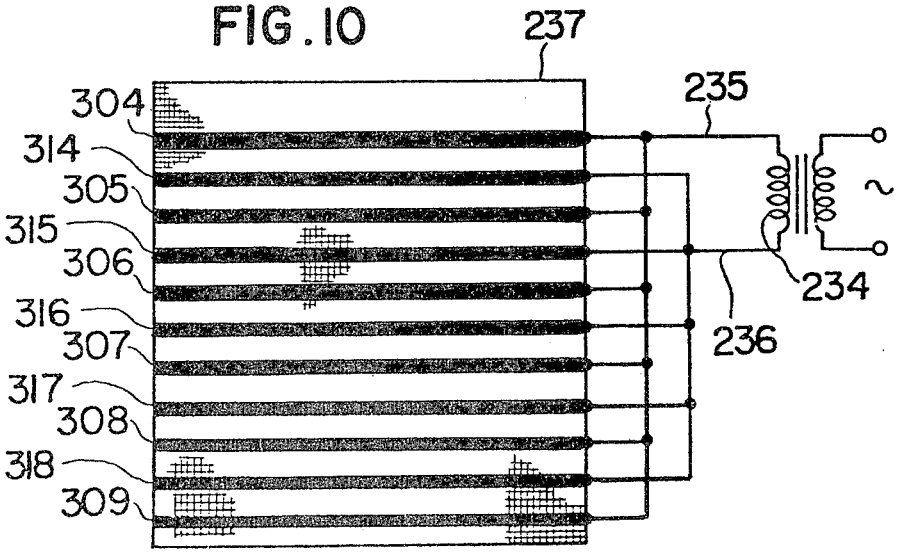
Figure 11:
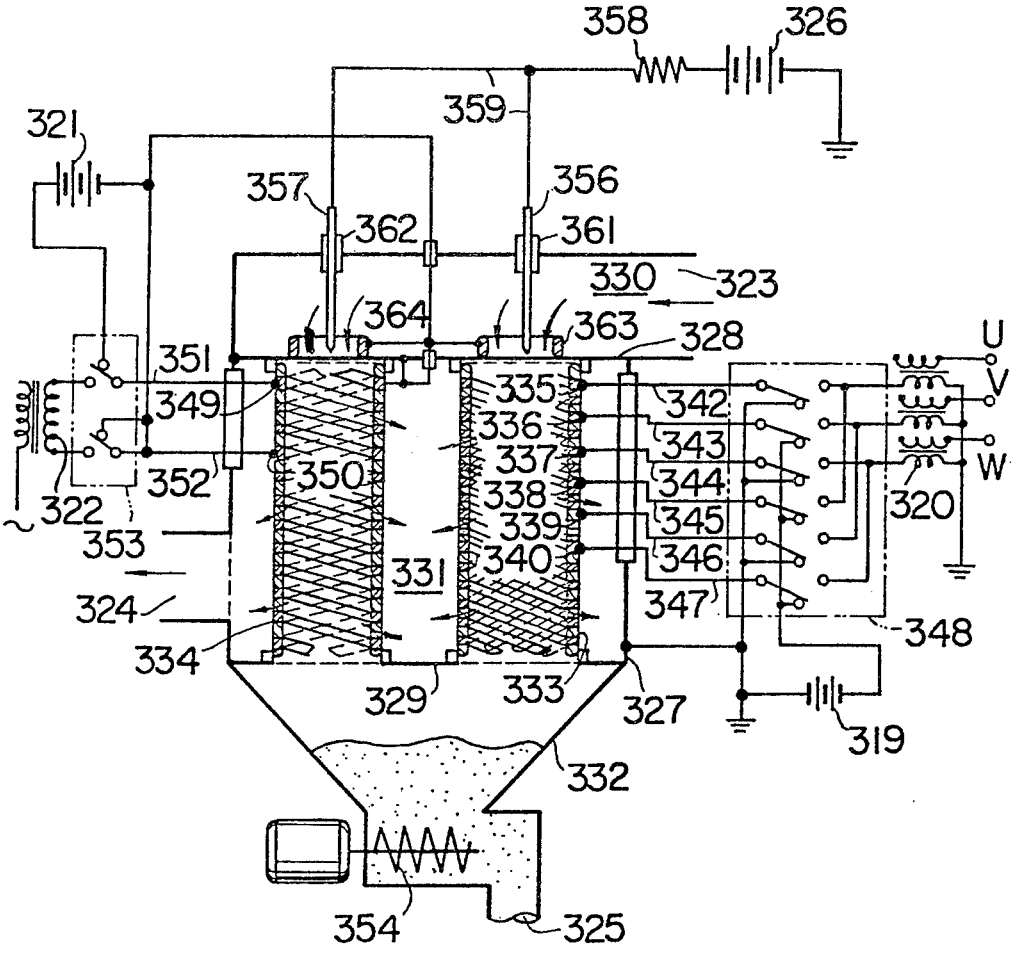

FIG. 8 is a still another enlarged plan and a connection diagram of a filter cloth for constituting an electric field curtain of contact type of traveling wave type, FIG. 9 is a sectional view showing the section XVII—XVII in FIG. 8, FIG. 10 is a plan and a connection diagram showing another embodiment of the filter cloth, FIG. 11 is a longitudinal sectional view of a dust collecting apparatus incorporating the filter cloth shown in FIGS. 6 and 8, the left filter cloth cylinder comprising electric yield curtain apparatus of stationary wave type while the right one comprises such apparatus of traveling wave type.

Figure 12:
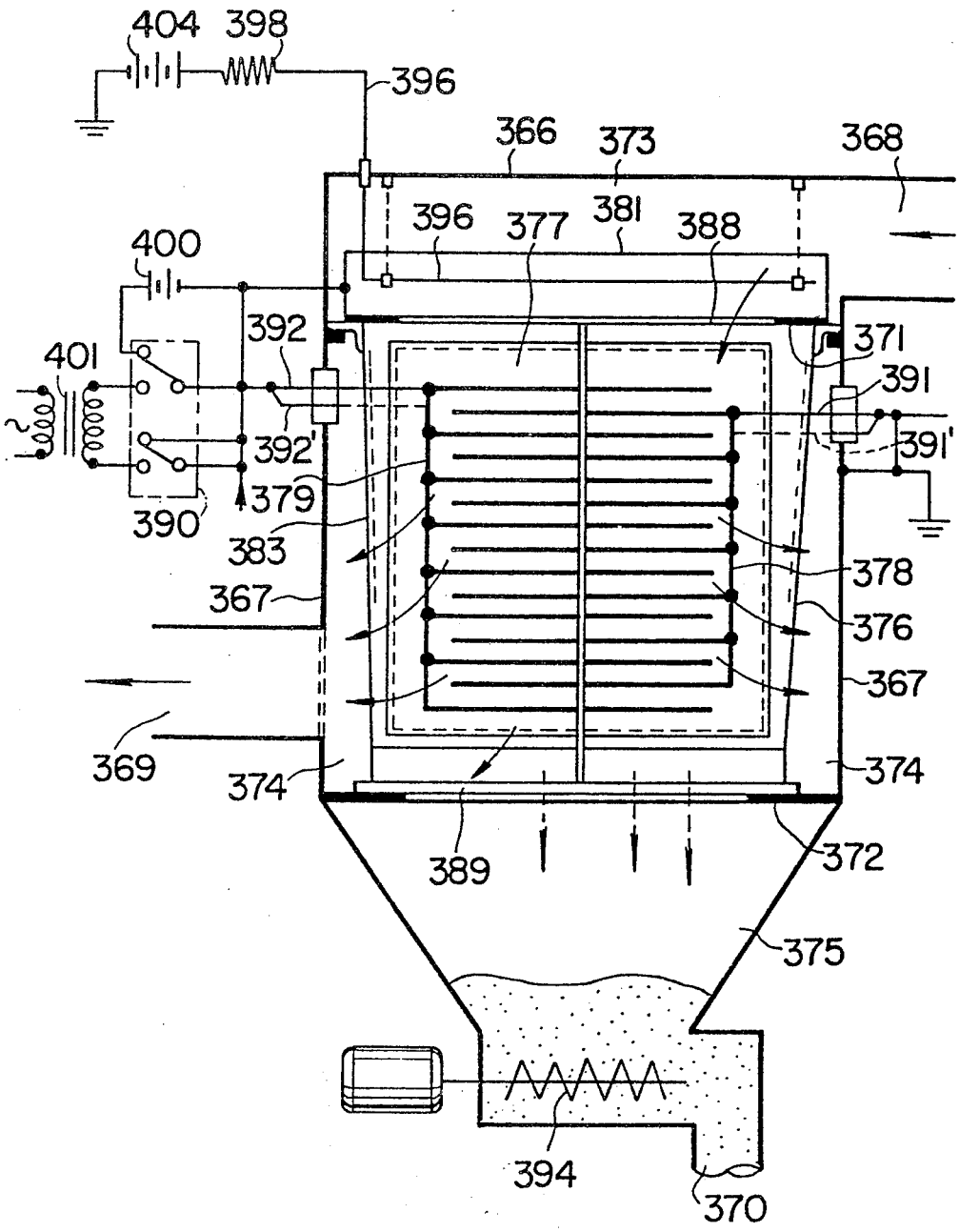

FIG. 12 is a longitudinal sectional view of another embodiment of the dust collecting apparatus incorporating the present filter cloth.

Figure 13:
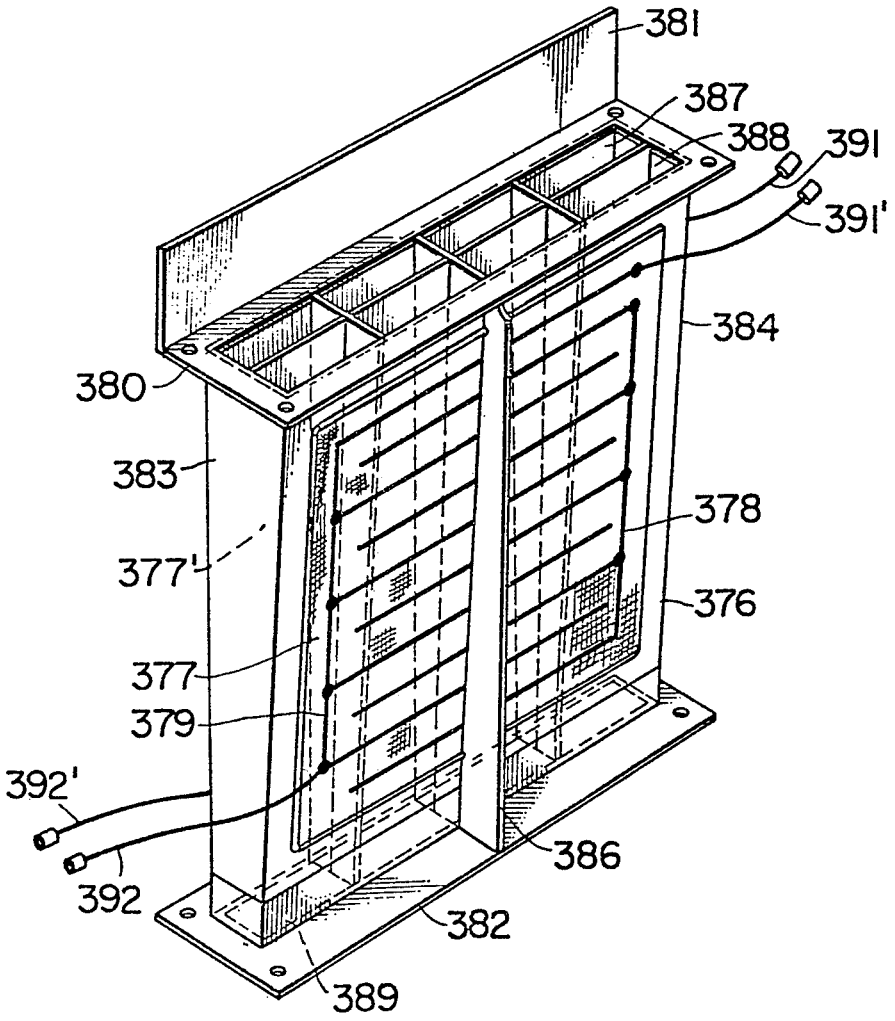

FIG. 13 is a perspective view of the filter cloth box in the embodiment in FIG. 12.

Figure 1:
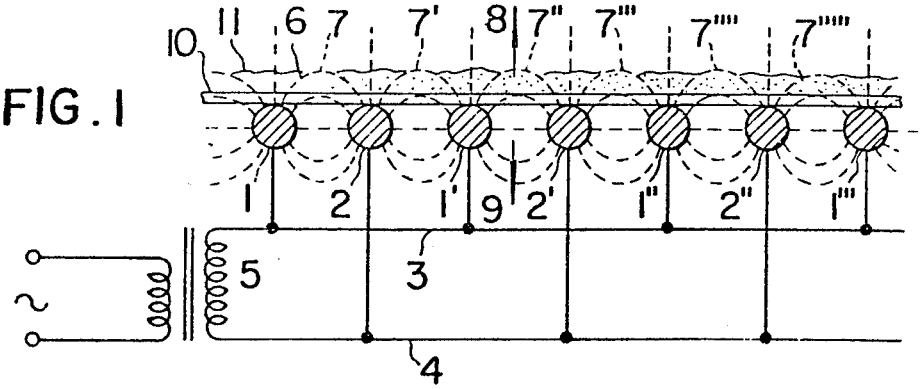
FIG. 1 is a diagrammatic view of an electric field curtain of contact type of stationary wave type for the explanation of the principle and the method of constitution of the present invention.

Referring now to FIG. 1, a group of columnar electrodes 1, 2, 1′, 2′, . . . are arranged parallel with each other at equal intervals on one and the same plane (or curved surface) in insulating relation with each other. They are connected alternately with conductors 3, 4 and each conductor is connected to a terminal of an AC power source 5. There is created a series of stationary wave alternating constantly varying electric fields 7, 7′, 7″, . . . neighboring each other as shown by the electric lines of force 6 in the space between said electrodes and also in their environment. This series of stationary wave alternating constantly varying electric fields 7-7′-7″- . . . , as already stated, has a strong electrodynamical repulsive action on the electrified light bodies in its neighborhood in the direction away from said series of electrodes 1, 2, 1′, 2′, . . . , i.e. in the directions of the arrows 8, 9 and thus is called the electric field curtain of stationary wave type. If a dielectric layer 10 is arranged in proximity or in contact with said series of electrodes 1, 2, 1′, 2′, . . . and if light bodies of conductor, semiconductor or dielectric, in the nature of dust particles, fibre, or the like, are brought into contact with the upper surface of said dielectric layer 10, then said light bodies 11 are electrified intensely immediately by contact electrification and then by the action of said alternating unequal electric field of stationary wave type 7, 7', 7'', . . . penetrating through said dielectric layer 10 they receive the alternating electric force in the direction of the strong electric lines of force as well as the strong electrodynamical repulsive force in the direction of the arrow 8, so that the light bodies are peeled off from said dielectric layer 10 and are levitated in the space above it. When said light bodies 11 are piled on said dielectric layer 10 comparatively thickly, they may not always be peeled off and made to float but in general an intense perturbed motion is imparted to them by the alternating electric force. In this case those which are within the piled up layer and do not contact with said dielectric layer are in general electrified by contact with each other in reversed polarity by the contact electrification occuring between said light bodies, and then the same perturbation effect or peeling off and floating effect will be given.

Figure 2:
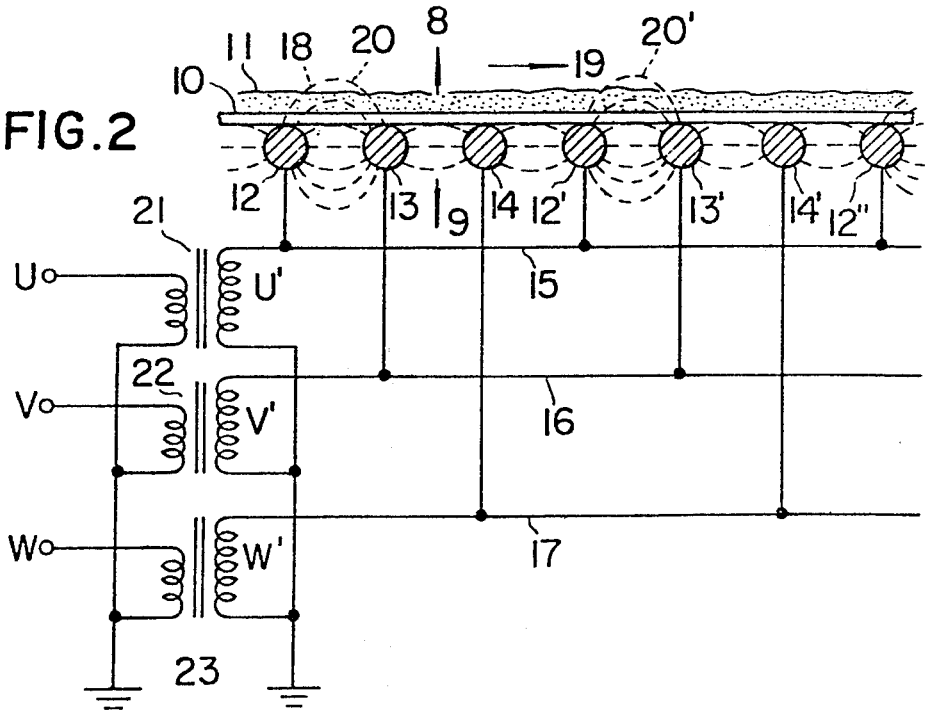
FIG. 2 is a diagrammatic view of an electric field curtain of contact type of traveling wave type for the same purpose as the above.

As shown in FIG. 2, a group of columnar electrodes 12, 13, 14, 12', 13', 14', . . . is arranged parallel to each other and at equal intervals, in insulating relation, on one and the same plane (or curved surface). The electrodes are divided into three groups by connecting every third electrode with one of the conductors 15, 16, 17 and the conductors are then connected to the secondary terminals U', V', W' of three transformers 21, 22, 23 in order, with the neutral points of Y connections connected to a three-phase AC power source U, V, W, so that a series of traveling alternating constantly varying electric fields 20, 20', . . . are produced in the space between and in the environment of said group of electrodes, having the electric lines of force as indicated with 18 and traveling in the direction of the arrow 19. This series of traveling alternating constantly varying electric fields 20, 20', . . . powerfully repels the light bodies in its neighborhood electrodynamically in the direction away from said group of electrodes 12, 13, 14, 12', 13', 14'3 . . . , i.e., in the direction of the arrows 8, 9 and at the same time exerts a driving action on the light bodies, irrespective of the polarity of the charges on them, in the direction of travel of said traveling wave, i.e., in the direction of the arrow 19. If a dielectric layer 10 is arranged in proximity to or in contact with said series of electrodes 12, 13, 14, 12', 13', 14', . . . and the light bodies 11, of conductor, semiconductor or insulator material, and of the shape of dust particles, fibre, or the like, are put on its upper surface, thus effecting contact electrification between the bodies and said dielectric layer 10, then the light bodies are peeled off the dielectric layer 10 and made to float over it, receiving an intense electrodynamical repulsive force in the direction of the arrow 8 as well as an alternating electric force in the direction of the electric lines of force 18, and they are transported in the direction of the driving force. If said light bodies 11 are piled in comparatively large thickness on said dielectric layer 10, said light bodies are not necessarily peeled off and floated, but they are shifted in the direction of the arrow 19 by receiving in general an intense perturbing motion from the alternating electric force. In this case even the light bodies which do not contact said dielectric layer 10 receive quite equally the actions of peeling off, floating and transporting effects as they are electrified in reverse polarity to each other as the result of contact electrification between one another. In the example of the present figure there is shown the case where a three-phase AC power source is used as the power source, but the traveling wave alternating constantly varying electric field in the electric field curtain of contact type of traveling wave type is in general formed by dividing a group of electrodes into n groups and connecting every nth electrode in order to an n-phase AC power source.

In the constitution of the above mentioned electric field curtain of contact type of stationary wave type or traveling wave type, as the dielectric, those of plate state, layer state, fibrous layer state, porous layer state, cloth state, net state or of any other arbitrary shapes, states and materials may be utilized, and as the group of electrodes for forming the electric field curtain the insulator coated conductors arranged on a surface, woven in network or in cloth are used and then these conductors are employed as a group of electrodes for the formation of the electric field curtain, or else these may be constituted by the organic dielectrics in the interior of which are embedded said group of electrodes. Further the dielectric should not necessarily be in a plane shape, but those of cylindrical shape, rectangular duct shape, conical shape, hopper shape or any other arbitrary shape will do as well. In responding to this the group of electrodes for the constitution of electric field curtain need not necessarily be a group of straight electrodes, but those of annular shape, spiral shape or any other arbitrary shape and of columnar state, foil state or any other arbitrary state, and further coated with suitable insulators will do as well. Further said group of electrodes can be arranged not only in one row but two, three or more arbitrary rows in proximity to or in contact with said dielectric.

Further the electric field curtain of contact type comprising the group of electrodes and the dielectric layer may not only be utilized by simply making use of it as a single layer, but also for poly layers, and, as occasion demands, may also be utilized by giving mechanical vibration or by sending an air current through the dielectric layer which is made permeable. Moreover said group of electrodes may simply be applied with a single-phase or a poly-phase AC voltage, or a DC voltage may be superimposed upon the former. Besides the charge to be given to said light bodies can originate not only from contact electrification, but also as necessity demands can be imparted by means of corona discharge or any other suitable methods.

Figure 3:
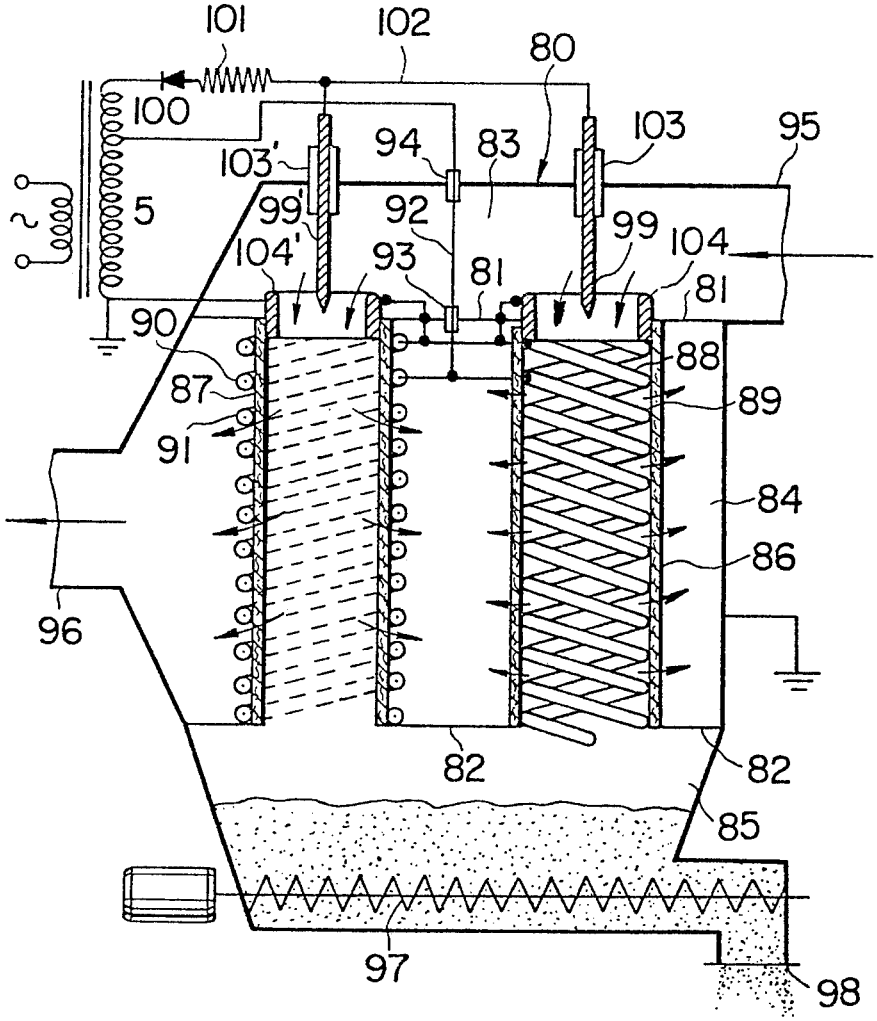
FIGS. 3 and 4 are respectively longitudinal sectional view of embodiments of the present invention, the left half portion in each case being an embodiment in which the electrodes are arranged on the exterior surface of the filter cloth and the right half portion being one in which the electrodes are on the interior surface of the filter cloth.

FIG. 3 is one of the embodiments of the apparatus utilizing the electric field curtain of contact type, of stationary wave type according to the present invention for the filter dust collection of dust particles and especially it is applied to a bag filter having a cylindrical filter cloth layer such as is described below. The main body 80 of the dust collecting apparatus is divided into an upper portion 83, a middle chamber 84 and a lower hopper 85 by the horizontal partitions 81 and 82. In the middle chamber 84 there are arranged in fixed relation, vertically as shown in the figure, cylindrical cloth filters 86, 87. Each filter can comprise either a single cloth layer or plural layers, and in the latter case the layers can be of the same kind or in combinations of several kinds. In said filter 86, . . . there are arranged a pair of spiral electrodes 88, 89, coated with insulator, in the interior of the layers and in contact to their inner surface, at an interval of 2 cm, in parallel. On the outside of the filter cloth 87 a pair of the spiral electrodes 90, 91 coated with insulator are arranged, in contact with the exterior surface of said cloth and in parallel with each other at intervals of 2 cm. Of the spiral electrodes 88, 89 and 90, 91, those designated 88, 90 are electrically connected with the upper partition 81, which is made of a metal and is grounded together with the main body of the dust collecting apparatus to the grounded terminal of a single-phase A.C. power source 5. The electrodes 89, 91 are connected with the ungrounded terminal of the power source 5 via the conductor 92 through the insulation tubes 93. Therefore the cylindrical filter cloth layers 86, 87 produce an electric field curtain of contact type of stationary wave type. The dust containing gas introduced into the upper chamber 83 from the inlet 95 passes through said group of cylindrical filters 86, 87 from the interior thereof to the exterior and is filtered of its contained dust by them and then the gas is exhausted outward from the outlet 96 in a purified state. The dust piled up on the interior surface of the cloth filters is swept off by the above-mentioned electrodynamical peeling off action and after having fallen into the lower hopper 85 is exhausted outward via the dust exhausting outlet 98 by means of the transporting machine 97. The needle electrodes for corona discharge 99, 99' are supported by the porcelain tubes 103, 103' and applied with negative high DC voltage from the DC high voltage power source 100 via the protective resistance 101 and the conductor 102. A negative corona discharge is established between the needle electrodes and the coaxial confronting grounded annular electrodes 104, 104, thus supplying a negative ionic current. Accordingly when the gas passes this portion the contained dust is charged intensely and the peeling off and the sweeping off action of the electric field curtain of contact type of stationary wave type in the filters 86, 87 is promoted.

Figure 4:
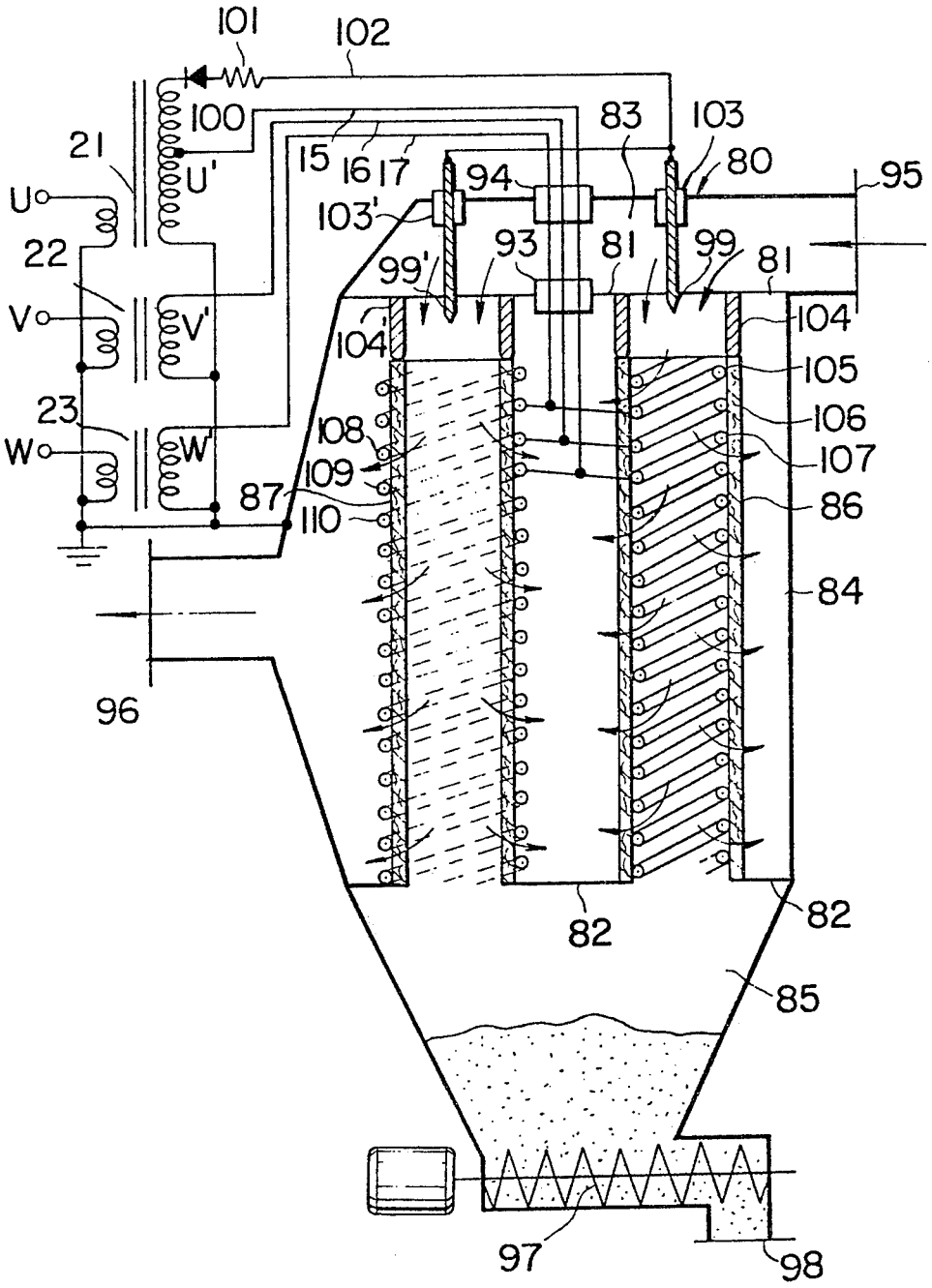

FIG. 4 shows one of the embodiments of the apparatus utilizing the electric filed curtain of contact type of traveling wave type according to the present invention. A bag filter having the same cylindrical filter cloth layer as above is applied also to this. The elements indicated with numerals from 15 to 104 are the same as those indicated with the same numerals in FIG. 3. In the interior of each cylindrical filter cloth layer 86 are arranged three spiral electrodes with insulator coating in contact with the inner surface of the layer and at an interval of 2 cm. Further on the outside portion of another group of cylindrical filter cloth layers 87 are arranged three similar spiral electrodes 108, 109, 110 with insulator coating as above, in parallel to each other and at an interval of 2 cm. These groups of electrodes 105, 106, 107 and 108, 109, 110 are applied respectively with three-phase alternating voltages through the conductors 15, 16, 17, so that the cylindrical filter layers 86, 87 are constituting an apparatus of electric field curtain of contact type of traveling wave having the alternating constantly varying electric field traveling downward along the inner surface of said layers. Accordingly the dust introduced with the gas from the inlet 95 is electrified beforehand while passing between the corona discharge electrodes 99, 99', . . . and the grounded annular electrodes 104, 104', . . . The dust adhered to and piled on the inner surface of said cylindrical filter cloth layers is peeled off vehemently by the electrodynamical action and driven downward at the same time, and thus falls into the lower hopper. If the group of the spiral electrods 90, 91 or 108, 109, 110 are arranged for the constitution of the electric field curtain of contact type, in the down stream side of the filter cloth layer 87 with respect to the gas flow in the embodiments shown in FIG. 4 and in contact with its outside, then the electrodes act as a suitable support against the load originating from the wind pressure received by the filter cloth and thus an advantage will be obtained in prolonging the life of the filter cloth. It will be evident that the electrodes 88, 89 and 90, 91 or 105, 106, 107 and 108, 109, 110 may be of spiral shape, annular shape, columnar shape, polygonal shape, strip shape or of any other suitable shape.

Further according to circumstances it goes without saying that a conductive coating of suitable shape may be shaped, painted or evaporated on the surface of the filter cloth by means of conductive coating materials, and, further, may be formed by attaching suitable conductive fibres onto the filter cloth layer or by weaving them into its interior. The material of the filter cloth may be synthetic resins such as nylon, tetron and teflon, glass fibre or any other dielectric substances.

Figure 5:
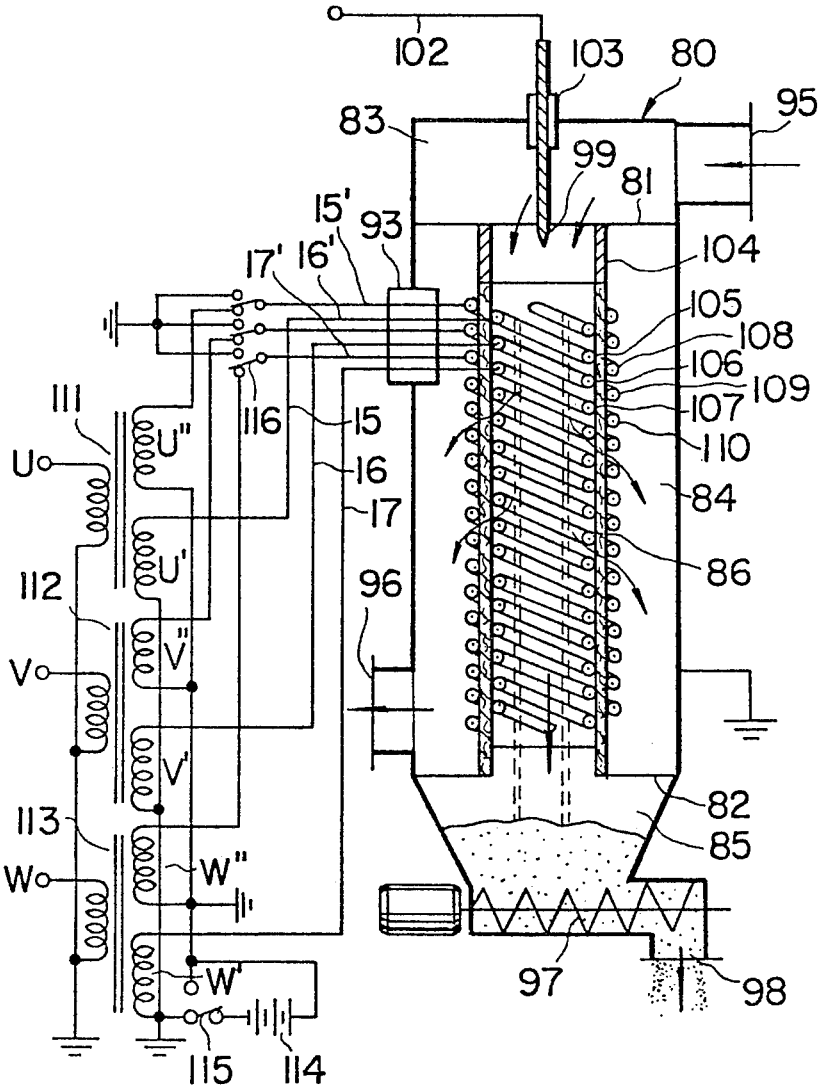
FIG. 5 is a longitudinal sectional view of another embodiment according to the present invention.

FIG. 5 is another embodiment of the apparatus utilizing the electric field curtain of contact type of traveling wave type according to the present invention for collection of dust particles, in which a group of electrodes are arranged in contacting relation on both sides of the dielectric filter cloth layer and further, as occasion demands, promotion of filtering and dust collecting effects is achieved by superposing a DC electric field on the alternating constantly varying electric field produced within the filter cloth layer. The elements indicated by numerals from 80 to 110 in the figure are the same as those indicated by corresponding numerals in FIG. 4. The three groups of spiral electrodes with insulator coatings are arranged, the in parallel to each others and at equal intervals, in contact on the inner and outer surfaces of the cylindrical filter cloth layer 86. Now the group of spiral electrodes 105, 106, 107 in the interior are connected via the conductors 15, 16, 17 through the porcelain tube 93 to the terminals U', V', W' of the secondary of the transformers 111, 112, each of which has two secondary windings, and the group of electrodes 108, 109, 110 on the exterior are connected via the conductors 15', 16', 17' through the porcelain tube 93 to other terminals U'', V'', W''. And the DC power source 114 is inserted at neutral points of the group of the secondary windings. Then an electric field curtain of contact type of traveling wave type having the alternating constantly varying electric field traveling in downward direction is produced in the neighboring of the inner and outer surfaces of and in the interior of the filter cloth layer 86; and though the field itself as already described offers very effective filtering and dust collecting action, yet a DC electric field is formed between the two inner and outer groups of electrodes 105, 106, 107 and 108, 109, 110, penetrating the filter cloth layer, so that even the electrified particles of very minute diameters which tend to pass through the filter cloth layers are more effectively made to adhere to and be captured by the filter cloth by reason of the DC electric force. If such an action is not required, it is of course only necessary to connect the switch 115 to the left side and to cut off the DC power source 114. Further the outside group of electrodes 108, 109, 110 may be grounded and in that case the multiple switch 116 is closed in the upward direction, thus cutting off the secondary windings U'', V'', W''.

Figure 7:
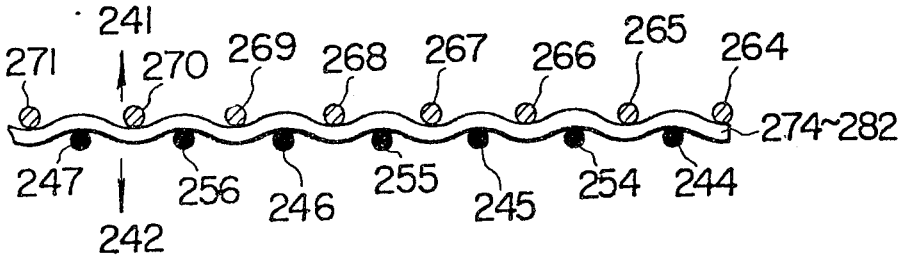
FIG. 7 is a sectional view showing the section XV—XV in FIG. 6.

FIG. 6 and FIG. 7 show examples of filter cloth of the system of the electric field curtain of contact type of stationary wave type woven of conductive fibrous string (hereinafter called conductive string) and insulating dielectric fibrous string (hereinafter called dielectric string). There is shown the case of a plain weave but the use of a cross weave, a satin weave or a duplicate weave will do as well.

The electrodes 244–247 and 254–256 comprise conductive strings alternating in the woof with dielectric strings 264–271, while the warp is made up solely of dielectric strings 274–282.

The conductive strings are connected in two groups, so that alternate conductive strings 244, 245, 246, 247 are connected by conductors 284, 285, 286, and the intermediate conductive strings are similarly connected, as electrodes 254, 255, 256 by conductors 294, 295. When each of the conductor string groups is connected to one of the terminals of a single-phase AC power source 234 via the conductors 235, 236 as shown in the figure, a filter cloth is constituted which can be applicable for constituting an electric field curtain of contact type of stationary wave type.

Now let it be assumed that the dust containing gas passes toward the surface of the filter cloth from the top of the paper sheet in the figure, then the dust is suppressed at the surface of the filter cloth by ordinary filtering action and is piled up on it, and is electrified by contact at the same time. Therefore the dust receives the perturbation effect as well as the repulsive force in the directions of the arrows 241, 242 by the electric field curtain of contact type and so is peeled off compulsorily. Now if the second characteristic of the present invention is added to this and so the dust is charged beforehand by means of a suitable method such as a corona discharge, etc., a part of the dust is suppressed in non-contacting manner by the action of the electric field curtain at the front of the filter cloth before reaching it. Then the dust falls and is collected, and the remaining dust reaching the filter cloth receives violently the above action of the electric field curtain of contact type more than in the case of no preliminary electrification.

FIG. 8 and FIG. 9 show the constitution of the filter cloth of the system of the electric field curtain of contact type of travelling wave type. In the figure there is shown the case of the use of the three-phase AC power source and this method may of course be extended easily to the method of using a poly-phase AC power source in general.

In this case the conductive strings comprising the electrodes are connected in three groups, and each group is connected with one of the terminals of a three-phase A.C. power source R, S, T. It will be understood that the conductive strings of each group can be connected with one another in series, in parallel or in series-parallel, so long as they will be always at the same potential.

In the above embodiments of the filter cloth of the system of electric field curtain of contact type carbon fibre is most suitable for the electrode strands as it is stable chemically as well as physically and withstands high temperature. However any conductive or semi-conductive fibre string other than this, for example metallic fibre string, conductive glass fibre string or mixed string may be applicable as well. As occasion demands the wires such as polimide wire and amideimide wire, etc., are possible to be applicable. As the dielectric wire glass fibre is especially adequate as it is stable chemically and withstands high temperature, but, organic synthetic fibre of every kind processed adequately on the surface or not, for example nylon fibre string, polyester fibre wire or fibre string NOMEX (trade mark) can be applicable as well.

FIG. 10 shows another method of constituting the filter cloth of the system of the electric field curtain of contact type. The group of electrodes 304 – 309, 314 – 318 are arranged in parallel with and insulated from each other on the insulating cloth by attaching and impregnating a conductive painting, pigment or dyestuff such as carbon black to the cloth, or are woven with conductive fibre string or insulating, gas permeable, unwoven cloth 237, or by textile printing or printing, etc., or juxtaposing or sewing together a conductive strip body such as a carbon tape. Besides this it is possible to arrange a group of electrodes for the electric field curtain of contact type in parallel with and insulated from each other by attaching, stratifying or molding the conductive fibre by the electrostatical setting method on one side or both sides of an insulating unwoven cloth or porous plate.

The filter cloth constituted as above can be easily processed with fluorine resin or silicon even afte the arrangement of the electrodes so that by this means it is possible to maintain the specific character of the insulation for a long time by preventing the production of a rough nap in the conductive string.

The electrode to be arranged in the filter layer as the characteristic of the present invention is in general adequate if of a width of less than 5 cm and of the interval between the electrodes, measured by the shortest distance, is less than 5 cm. And the frequency of the alternating current of the power source to be used is suitably of less than 200 Hz.

FIG. 11 shows an embodiment of the invention for use in combination with a machine that produces a great deal of dust such as an electric furnace, a cement mill, etc.

The main body of the dust collecting apparatus is divided into the upper chamber 330, the middle chamber 331 and the the lower hopper 332 by the partition plates 328, 329 and these partition plates 328, 329 and the external wall 327 are grounded. In the middle chamber 331 is arranged the novel cylindrical filter cloth or filter layer 333 or 334 open at both top and bottom ends and oriented vertically. In the filter cloth tube 333 are woven six electrodes 335-340 of carbon fibre conductive string constituting an electric field curtain of contact type of traveling wave type in spiral configuration encircling the filter cloth tube. The dielectric string of the filter cloth is made of glass fibre. A lead-out wire 342–347 from each of the six stripes comprising the spiral electrodes is connected to the AC-DC change over switch 348 as shown in the figure. By means of the AC–DC change over switch 348 the electrodes can be supplied with a DC voltage from the DC power source 319 or a three-phase voltage from the three-phase transformer 320. In the filter cloth tube 334 the electrodes 349, 350 of carbon fibre conductive string constitute an electric field curtain of contact type of stationary wave type are woven to spirally encircle the filter cloth tube.

The electrodes 349, 350 are each connected to the single-phase AC power source 322 and DC power source 321 through the AC - DC change over switch 353 via the leading-out wires 351, 352. The electrode 350 is grounded to the partition plate 328.

Now let a dust containing gas be introduced into the upper chamber 330 through the inlet 323 while an AC voltage is applied on the filter cloth layer 333, then the gas passes from the interior of the filter cloth layer 333 or 334 toward the exterior and at this time by the filtering action of the filter cloth and the action due to the electric field curtain of contact type of stationary wave type or traveling wave type the gas becomes purified due to the removal of the contained dust particles and then is exhausted outward from the outlet 324. The dust particles adhering to the filter cloth are swept off by the peeling off action of the electric field curtain of contact type, fall into the lower hopper 332 and are exhausted outward from the exhaust outlet 325 by means of the transporting machine 354.

The corona discharge electrodes 356, 357 are supplied with the negative DC high voltage from the DC high voltage power source 326 via the protective resistance 358 and the conductor 359, supported by the porcelain tubes 361, 362. These produce a negative corona discharge with the grounded coaxial annular confronting electrodes 363, 364 and supply a negative ionic current. Accordingly when the gas passes through this portion the contained dust is charged beforehand, assisting the dust collecting effect in non-contacting manner by the electric field curtain of contact type comprising the filter cloth tubes 333, 334 and as the coarser particles are for the most part collected in front of the filter cloth the load on the filter cloth itself is largely alleviated.

FIG. 12 shows another embodiment of the filter dust collecting apparatus of the system of electric field curtain of contact type to be used in combination with machines that produce a great deal of dust.

The dust collecting apparatus itself 366 is divided into the upper chamber 373, the middle chamber 374 and the lower hopper 375 by the horizontal partition plates 371, 372, and the partition plates 371, 372 and the exterior wall are grounded. In the middle chamber 374 is a filtering box of wedge shape 376 comprising the novel filter cloth 377 and 377′ (refer to FIG. 13) of the system of the electric field curtain of contact type of stationary wave type according to the present invention, fixed on a frame that is illustrated in FIG. 16 and described hereinafter. The leading out wires 391, 391′, 392, 392′ are taken out respectively from the electrodes 378, 379 and 378′, 379′ arranged on said filter layer of filter cloth 377 and 377′, and then are connected to the AC - DC change-over switch 390 as shown in the figure. The D.C. voltage of the DC power source 400 or the secondary single-phase voltage of the single-phase transformer 401 is applied on the electrodes 378, 379, 378′, 379′ of the filter layer or filter cloth by means of the AC-DC change-over switch 390. The leading out wire 391 and the electrodes 378, 378′ on the filter that are connected with this leading out wire are grounded.

Now if an AC voltage is applied on the electrodes 378, 379, 378′, 379′ in the filter cloth 377, 377′ and a dust containing gas is introduced into the upper chamber 373 from the inlet 368, then the gas is sent downward from the upper hole 388 of the filter box, and it passes from the inside to the outside of the box through the filter cloth of the system of electric field curtain of contact type and is exhausted outside, passing through the middle chamber 374 and the outlet 369 in a purified state. The dust particles adhering to and piling on the filter cloth are swept off by the peeling off action of the electric field curtain of contact type of stationary wave type, fall into the lower hopper 375 from the lower hole 389 of the filter box and are exhausted outward from the exhaust outlet 370 by means of the transporting machine 394. The line electrode for the corona discharge 396 is supplied with negative DC voltage from the DC high voltage power source 404 via the protective resistance 398 and the conductor 399. It produces a negative corona discharge with the grounded plate-shaped confronting electrode 381 set on the upper flange frame of the filter box. Accordingly when the gas passes through this portion the dust particles contained therein are electrified to promote dust collection in the non-contact mode by the electric field curtain of contact type arranged in the filter cloths 377, 377.′ Since the greater the portion of the coarser particles is collected in front of the filter the load on the filter itself is largely alleviated.

FIG. 13 shows the details of the wedge-shaped filter box in the dust collecting apparatus of FIG. 12. In the upper portion of the filter box 376 there is a mounting flange 380 made of iron plate and as shown in the figure the confronting electrode of plate shape 381 for the corona discharge is set by welding or in an integral structure to its one side of the flange. In the lower portion there is a flange frame plate 382 made of an iron plate or a reinforced plastic for fixing the filter box to the lower partition plate 372, and it is connected with the flange 380 through side plates 383, 384. The filter cloths 377 and 377′ of glass fibre are extended on both surfaces of the frame work comprising the flange frame 380, 382 and the frame plates 383, 384, and the electrodes for the electric field curtain of contact type of traveling wave type 378, 379, 378′, 379, ′ having width of 3 cm and spaced at intervals of 3 cm, are formed afterwards by painting carbon black on the surfaces of these two filters and then the leading-out wires 391, 392, 391′, 392′ are taken out from each of them.

Although the above dust collecting apparatus shown in FIGS. 12 and 13 is based on the operational principle of the electric field curtain of contact type of stationary wave type, yet, as will be obvious from the embodiment of FIG. 11, it is easy to constitute the apparatus in FIGS. 12 and 13 as an apparatus following the operational principle of the electric field curtain of contact type of traveling wave type. And as a DC electric field is produced between the electrodes by applying a DC voltage instead of an AC voltage, by an AC-DC change-over switch 390, it is possible to obtain a filter dust collecting apparatus capable of realizing the ordinary electric dust collecting principle and the filter dust collecting principle at the same time.

I claim:

1. Apparatus for removing particulate material from a gas stream in which it is entrained, comprising:

A. wall means defining 1. a downwardly opening inlet for a gas stream in which particles are entrained,
2. an outlet for cleaned gas, spaced from said inlet and having its axis substantially out of alignment with that of said inlet, and
3. a passage for constraining gas entering the inlet to flow to the outlet and wherein there is a zone in which gas flowing from the inlet to the outlet undergoes a change in flow direction in the course of such flow;

B. a substantially tubular filter element of cloth-like material through which gas can pass, said filter element having its axis substantially coinciding with the axis of the inlet and having an upper end near the inlet, but being otherwise radially spaced from said wall means, said filter element being disposed at least in part in said zone and being arranged to have gas entering the inlet flow into the interior of the filter element and pass through the material thereof in flowing towards the outlet;

C. a plurality of elongated electrodes contiguous to said filter element, said electrodes being laterally spaced apart by substantially uniform distances along their lengths and being disposed entirely around and along the filter element;

D. means for connecting each of said electrodes with one terminal of an alternating voltage source, each electrode with a terminal other than that which its laterally adjacent electrodes are connected, to produce a constantly varying alternating electric field between every pair of laterally adjacent electrodes whereby particles in a gas stream flowing between the electrodes are repelled from the electrodes; and E. means defining an upwardly opening receptacle beneath the filter element, into which particles repelled by the electrodes are induced to move.

2. The apparatus of claim 1, further characterized in that said electrodes are disposed at the outer surface of the filter element.

3. The apparatus of claim 1 further characterized in that said electrodes are disposed at the inner surface of the filter element.

4. The apparatus of claim 1, further characterized in that said electrodes comprise electrically conductive filaments woven into the material of the filter element.

5. The apparatus of claim 1, further characterized in that said electrodes are connected with the three terminals of a three-phase alternating voltage source.

* * * * *